US005377930A

United States Patent [19]

Noyes

[11] Patent Number: 5,377,930

[45] Date of Patent: Jan. 3, 1995

[54] PAPER TURN-UP SYSTEM AND METHOD

[75] Inventor: Steven Noyes, Crown Point, N.Y.

[73] Assignee: International Paper Company, Purchase, N.Y.

[21] Appl. No.: 4,985

[22] Filed: Jan. 15, 1993

[51] Int. Cl.[6] ..... B65H 19/26; B65H 19/28

[52] U.S. Cl. ..... 242/521; 242/532.2; 242/542.3

[58] Field of Search ..... 242/56 R, 56 B, 65, 242/56 A, 521, 526, 526.3, 532.2, 542.3; 83/22, 177

[56] References Cited

U.S. PATENT DOCUMENTS

| | | | |
|---|---|---|---|
| 1,279,756 | 9/1918 | Pope | 162/286 X |
| 1,878,184 | 9/1932 | Roesen | 242/56 RX |
| 2,006,499 | 7/1935 | Fourness et al. | 242/56 R |
| 2,984,426 | 5/1961 | Johnson | 242/56 A |
| 3,891,157 | 6/1975 | Justus | 242/56.2 |
| 4,182,170 | 1/1980 | Grupp | 83/177 |
| 4,445,646 | 5/1984 | Karr et al. | 242/56 R |
| 4,923,567 | 5/1990 | Liedes et al. | 162/193 |

*Primary Examiner*—Joseph J. Hail, III
*Assistant Examiner*—John Q. Nguyen
*Attorney, Agent, or Firm*—Luedeka, Neely & Graham

[57] ABSTRACT

A system and method for turning up a web of paper moving in a tensioned condition across the surface of a rotating reel at the winder of a paper making machine from a first drum to a second drum utilizes a conduit for receiving air from a pressurized air source and having a discharge end through which pressurized air received from the source exits the conduit in an air stream. A stand supports the conduit adjacent the reel for movement between an operative position at which the discharge end is positioned adjacent an edge of the web and a non-operative, out-of-the-way position situated to one side of the reel. A cylinder assembly is connected between the conduit and the stand for moving the conduit between its operative and non-operative positions, and a solenoid valve is connected in-line with the conduit permitting a sudden stream of air to exit the discharge end upon actuation of the valve. When the conduit is positioned in its operative position and the air stream is directed toward an edge portion of the web, the air stream separates the edge portion along a path of separation so that the tension to which the web is exposed subsequently completes severance of the web from the formed path of separation to provide the web with a severed edge extending between the opposite side edges of the web, and so that the severed edge of the web is urged by the air stream toward the second drum for winding thereabout.

17 Claims, 4 Drawing Sheets

PAPER TURN-UP SYSTEM AND METHOD

BACKGROUND OF THE INVENTION

This invention relates generally to the winding of a moving paper web in sequence about two drums at the winder of a paper-making machine and relates, more particularly, to the transference of the moving web of paper from one drum about which the web is being wound to a second drum.

The winder of a paper-making machine with which this invention is concerned utilizes a rotating machine reel across which a moving web of paper is conveyed toward a first drum about which the web is wound. The first drum is positioned adjacent and cooperates with the reel so that rotation of the reel effects the rotation of the first drum. Normally, as the paper web is wound about the first drum, the web is maintained in a relatively taut, or tensioned, condition across the surface of the reel. In preparation of the transference of the web from the first drum to a second, i.e., empty, drum, the second drum is arranged in a superposed relation upon the reel so as to overlie the web of paper moving thereacross and positioned at a location disposed upstream (with respect to the direction of web movement) of the first drum.

Heretofore, the transference of the moving paper web to the second drum positioned as aforedescribed over the reel has been effected with a knife-like tool used adjacent the edge of the web and means providing a stream of air directable toward the web. More specifically, the knife-like tool is used to initiate a cut at a location substantially midway between the edges of the paper web, and the tension to which the web is exposed as it moves across the reel is sufficient to complete severance of the web from the initiated cut along paths extending outwardly along the web to the edges thereof. A stream of air from the air-providing means is directed at about the center of the web at the moment that the web is completely served so that the severed web end (situated on the upstream side of the path of severance) is urged by the air stream in the appropriate direction so that the severed end begins to wind about the second drum. The first drum is subsequently removed from its position adjacent the reel, and the second drum, while the web continues to be wound thereabout, is moved to the position previously assumed by the first drum. However, at high machine speeds (about 2600 feet per minute), this knife-initiation of the web severance is unsatisfactory. Moreover, the exposed knife presents a potential safety hazard.

Accordingly, it is an object of the present invention to provide a new and improved system for transferring a moving web of paper from a first drum to a second, i.e., empty, drum at the winder of the aforedescribed class.

Another object of the present invention is to provide such a system which is well-suited for use at relatively high machine speeds.

Still another object of the present invention is to provide such a system which is devoid of an exposed knife.

Yet another object of the present invention is to provide such a system which is uncomplicated in construction and effective in operation.

SUMMARY OF THE INVENTION

This invention resides in a turn up system and method for use at the winder of a paper making machine including a rotating reel having a surface across which a moving web of paper, under tension, is routed, a first rotating drum positioned adjacent the surface of the reel and about which the web of paper is being wound, and a second rotating drum positioned adjacent the surface of the reel so as to overlie the paper web moving across the reel toward the first drum.

The system of the invention includes a conduit for receiving air from a pressurized air source and having a discharge end through which pressurized air received from the source exits the conduit in an air stream. Support means within the system supports the conduit adjacent the reel for movement between an operative position at which the discharge end of the conduit is directed toward a portion of the web located adjacent an edge thereof and a non-operative, out-of-the-way position at which the conduit is situated to one side of the reel. The web portion toward which the discharge end is directed overlies the reel and is disposed generally between the first and second drums. The discharge end of the conduit is oriented in such a relationship with the web when the discharge end is positioned in its operative position that the air stream which exits the discharge end moves toward the web edge portion along a path having one directional component which is directed generally upstream of the web. The system also includes means for moving the conduit between its operative and non-operative positions and means for initiating a sudden steam of air through the conduit so that the sudden stream of air which exits the discharge end when the conduit is positioned in its operative position separates the edge portion along a path extending from the corresponding side edge of the web, the tension to which the web is exposed completes the severance of the web from the separated edge portion to provide the web with a severed edge extending transversely thereacross, and the severed web edge is urged away from the surface of the reel and toward the second drum for winding thereabout.

The method of the invention includes the steps involved in using the aforedescribed system. Such steps include the moving of the conduit into its operative position adjacent the wed and initiating the sudden steam of air through the conduit.

BRIEF DESCRIPTION OF THE DRAWING FIGURES

DETAILED DESCRIPTION OF THE ILLUSTRATED EMBODIMENT

Figure 1:
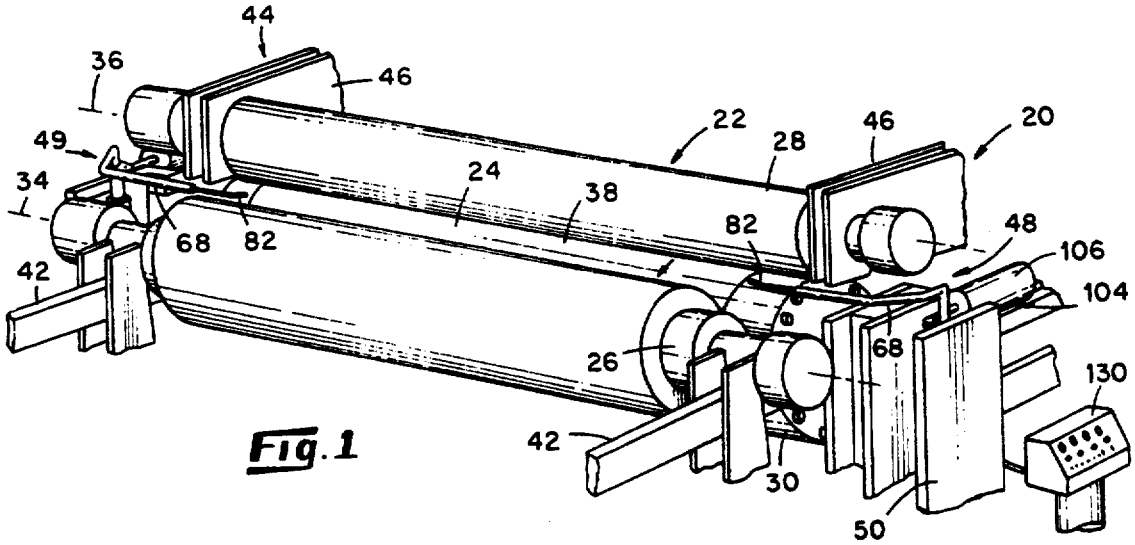
FIG. 1 is a fragmentary perspective view of a winder of a paper-making machine and a turn-up system embodying features of the present invention shown positioned adjacent the winder.

Turning now to the drawings in greater detail and considering first FIG. 1, there is illustrated a turn-up system 20 embodying features of the present invention and shown in an environment of intended use. More specifically, such environment includes the winder 22 of a paper-making machine for winding a moving paper web 24 in sequence about a first drum 26 and then a second drum 28. The winder 22 includes a reel 30 supported for rotation about an axis 32 (FIG. 2), and each of the drums 26 and 28 is rotatably supported adjacent and in such a relationship with the reel 30 that rotation of the reel 30 drivingly rotates the drums 26 and 28 about substantially parallel axes 34 and 36, respectively. The paper web 24 is wound about the first drum 26 until the first drum 26 is fully wound, and then the turn-up system 20 is operated in a manner described herein to sever the paper web 24, while the web 24 is moving, and direct the severed edge of the web 24 toward the second drum 28 where the web 24 is wound thereabout.

Figure 2:
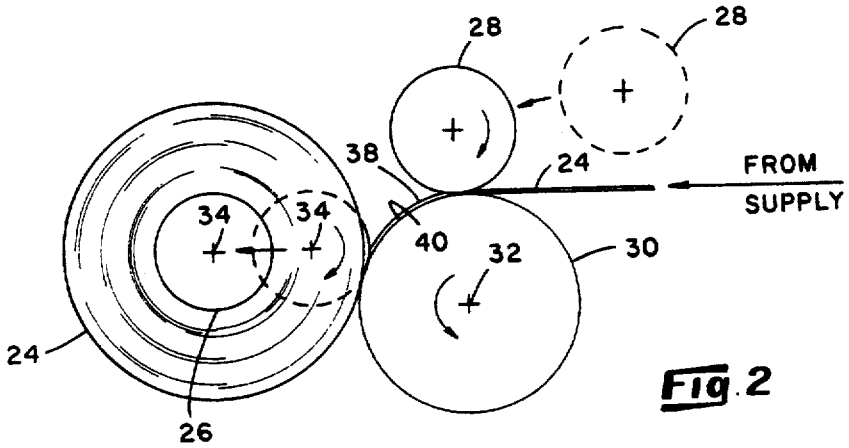
FIGS. 2 and 3 are schematic end elevational views of the winder of FIG. 1 illustrating various positions of two drums about which paper moving through the winder is desired to be wound.

With reference to the schematic view of FIG. 2, the first drum 26 is disposed to one side, or to the left as viewed in FIG. 2, of the reel 30 while being wound with the web 24, and the second drum 28 is positioned in a superposed relation upon the reel 30. The reel 30 is rotatably driven in a counter-clockwise direction, as viewed in FIG. 2, so that each of the first and second drum 26 or 28 is rotated in a clockwise direction, as viewed in FIG. 2.

The first drum 26 is rotatably supported upon a pair of rails 42 (FIG. 1) positioned at the ends of the drum 26 so that the drum 26 is disposed to one side of, or to the left as viewed in FIG. 2, of the reel 30. The first drum 26 is positioned adjacent this one side of the reel 30 throughout the duration of the winding operation. However, as the web 24 continues to be wrapped about the drum 26, the diameter of the wrapping increases about the drum 26 so that the drum 26 shifts along the rails 42 in a leftward direction, as viewed in FIG. 2, from a (rightwardmost) position illustrated in phantom in FIG. 2 away from the surface of the reel 30 toward a (leftward) position illustrated in solid lines in FIG. 2.

As the paper web 24 moves through the winder 22, the web 24 is fed from a supply (not shown) and moves across the surface, i.e., the upper peripheral portion 40, of the reel 30 and beneath and around the first drum 26. As the first drum 26 is rotatably driven by the reel 30, the web 24 is tightly wound about the drum 26, and the section, indicated 38 in FIG. 1, of the web 24 which overlies the reel 30 en route to the drum 26 is maintained in a relatively taut, or tensioned, condition.

The winder 20 also includes a transfer system, indicated generally 44, including primary arms 46 for moving the second drum 28 from a stored position into a readied position illustrated in FIG. 1 at which the web 24 is maneuvered from the first drum 26 onto the second drum 28. More specifically, the second drum 28 is moved from a position, such as is illustrated in phantom in FIG. 2, to a position as is illustrated in solid lines in FIG. 2 at which the drum 28 is superposed upon the reel 30 and overlies the web section 38 at a location disposed upstream in relation to the direction of movement of the web 22 across the reel 30.

The construction and operation of the transfer system 44 are well known in the art so that a more detailed description of the system 44 is not believed to be necessary. Suffice it to say that the system 44, by way of the primary arms 46, seizes the opposite ends of the second drum 28 when the drum 28 is positioned in an initial stored position and then proceeds to move the drum 28 to the superposed position upon the reel 30 where the web 24 is maneuvered from the first drum 26 onto the second drum 28. Upon completion of the maneuverance of the web 24 about the second drum 28, the first drum 26 is removed from the position (illustrated in phantom in FIG. 3) adjacent the reel 30 toward the position (illustrated in solid lines in FIG. 3) at which the drum 26 is spaced a considerable distance from the reel 30, and then the second drum 28 is moved from its superposed position (illustrated in phantom in FIG. 3) upon the reel 30 to the position (illustrated in solid lines in FIG. 3) adjacent the reel 30 and which position was formerly occupied by the first drum 26. The primary arms 46 then release the second drum 28 and are returned to an initial reference position at which a third, i.e. empty, drum is seized for the start of a subsequent transfer cycle. The size of the first drum 26 is visually monitored by an operator who controls the operations of the transfer system 44, as well as those of the turn-up system 20, at a command station 130.

For turning up the paper web 24 from the first drum 26 onto the second drum 28, the depicted turn up system 20 includes an air wand assembly, indicated 48 or 49, adjacent each side of the winder 22 as shown in FIG. 1 for forming a separation in the section 38 of the paper web 24 moving across the surface of the reel 30. Each wand assembly 48 or 49 is similar in construction and operating principle to that of the other of the wand assembly 49 or 48 so that only one wand assembly, i.e. the wand assembly 48, will be described in detail herein.

Figure 4:
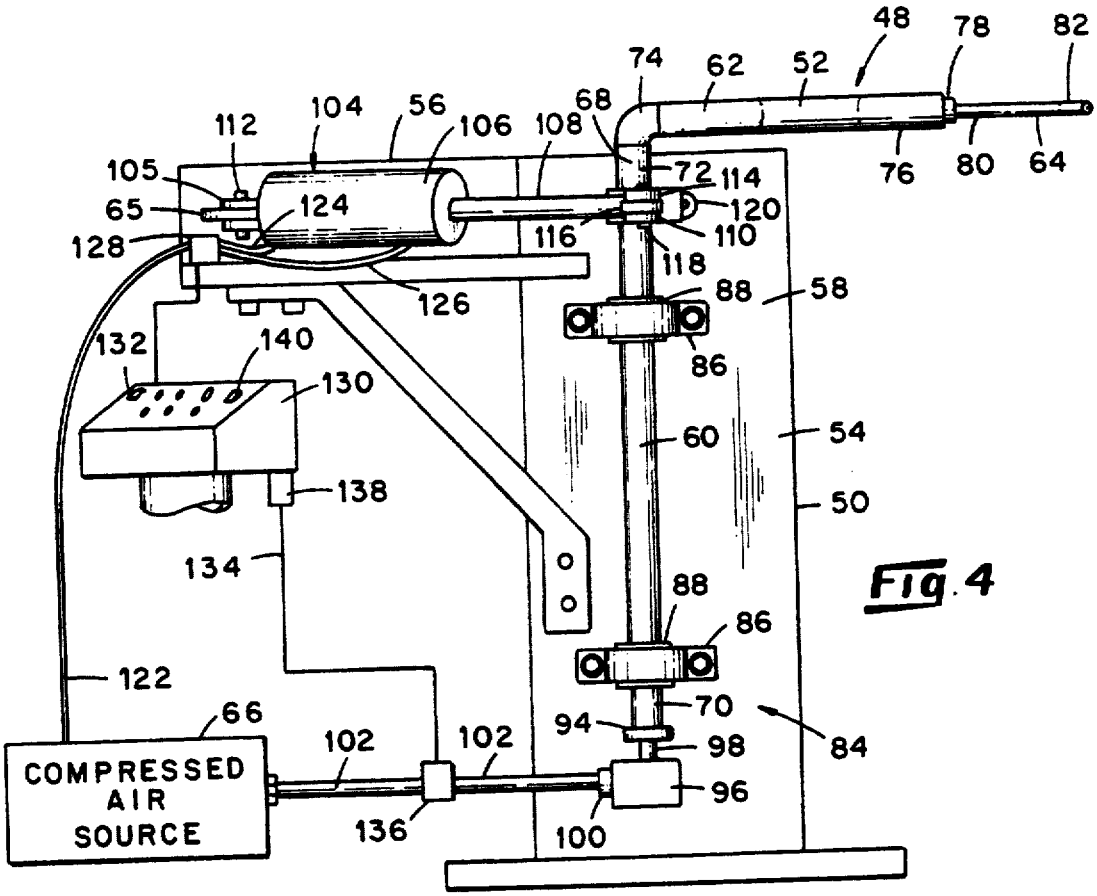
FIG. 4 is an elevational view of one of the wand assemblies of the turn-up system of FIG. 1.
Figure 5:
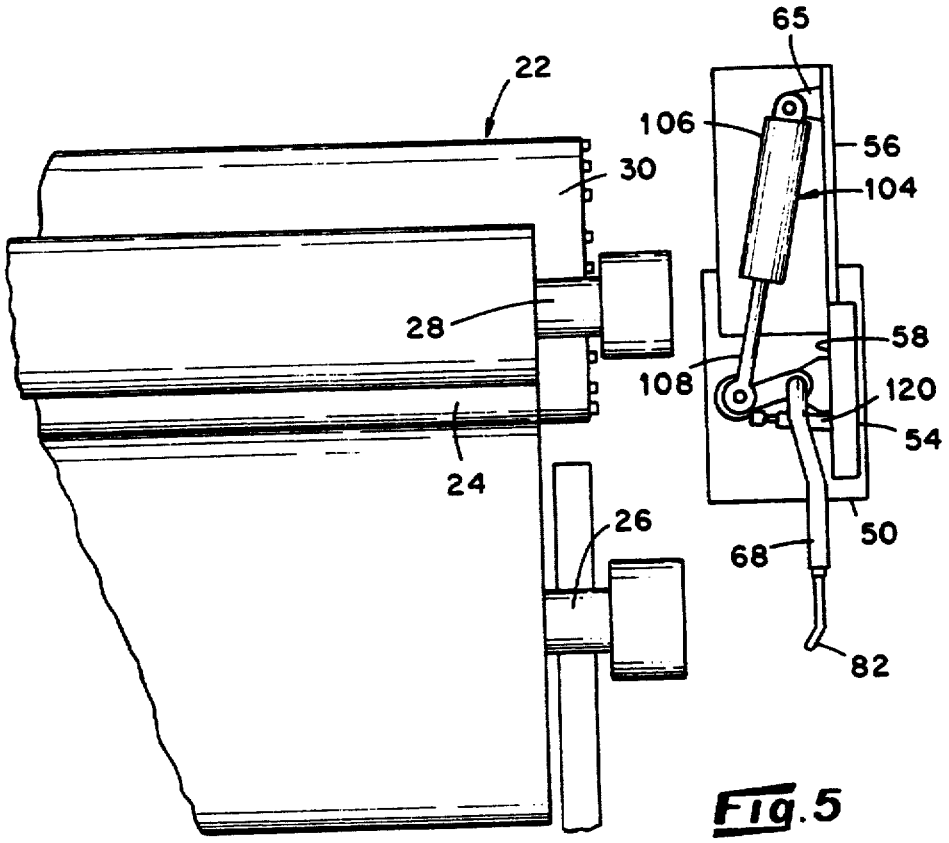
FIG. 5 is a plan view of the wand assembly of FIG. 4 as seen generally from above in FIG. 4.

With reference to FIGS. 4 and 5, the wand assembly 48 is supported by a support stand 50 positioned adjacent one side of the winder 22 and includes a conduit assembly 52 pivotally supported upon the stand 50. The stand 50 includes a columnar base 54 having a lower end which is adapted to rest upon the underlying floor and an upper end which is directed generally upwardly. The base 54 has a side which provides a substantially planar surface 58 against which the conduit assembly 52 is attached, as is described hereinafter, and the stand 50 also includes a vertically-oriented section 56 which is fixed in a stationary relationship with respect to the base 54. A cylinder mount 65 protrudes from one side of the section 56 for a purpose which will become apparent herein.

The purpose of the stand 50 is to provide a stationary support about which the conduit assembly 52 can be pivoted during an operation with the turn-up system 20. While the depicted stand 50 is adapted to rest upon the floor, a turn-up system 20 in accordance with the broader aspects of this invention may be designed to rest upon frame structure of the paper making machine disposed adjacent the winder 22 and/or braced against movement with suitable braces extending between the stand and adjacent components of the winder 22.

Figure 3:
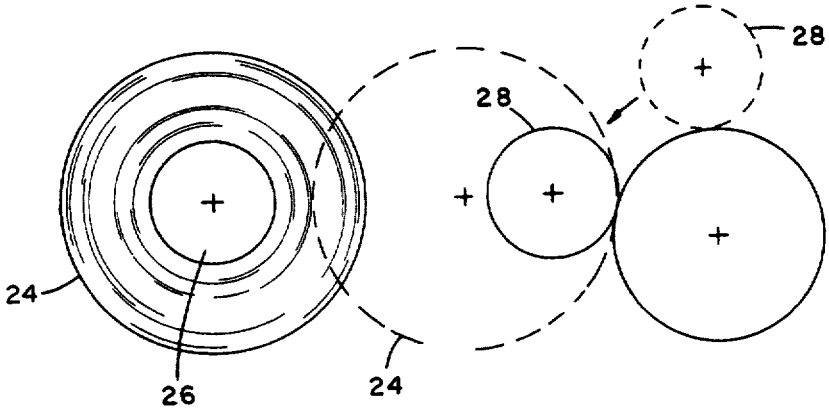

As best shown in FIG. 4, the conduit assembly 52 of the separation-forming means 48 includes a plurality of conduits 60, 62, 64 joined together so as to provide an L-shaped conduit arrangement 68 through which air is conducted from a source 66 of pressurized air toward the web 24. A first conduit 60 is oriented substantially vertically, as shown in FIG. 3, and has a lower end 70 through which air enters the arrangement 68 and an opposite upper end 72. A second conduit 62 is joined at one end to the upper end 72 of the first conduit 60 by means of an elbow 74 so that its opposite end, indicated 76, extends at substantially a right angle to the first conduit 60. The conduit end 76 is internally threaded for threadably accepting the male end of a plug member 78, and the third conduit 64 has an externally-threaded end 80 adapted to be threadably received by the female end of the plug member 78 and a free end 82 opposite the threaded end 80. The threaded connection between the plug member 78 and the third conduit 64 enables the conduit 64 to be easily attached and/or detached from the remainder of the arrangement 68 if, for example, the third conduit 64 is damaged and has to be replaced. As will be apparent herein, the free end 82 of the third conduit 64 provides the discharge end through which air moving from the source 66 exits the arrangement 68, and the shape of the third conduit 64 will be described in greater detail herein.

Although the conduits 60, 62, 64 of the conduit arrangement 68 may be comprised of any of a number of suitable materials, the conduits 60, 62, 64 of the depicted arrangement 68 are comprised of stainless steel. By way of example, the first conduit 60 has a length of about 24.0 inches and a diameter of about 1.25 inches, the second conduit 62 has a length of about 24.0 inches and a diameter of about 1.25 inches and the third conduit 64 has a length of about 31.0 inches and a diameter of about 0.5 inches.

Figure 6:
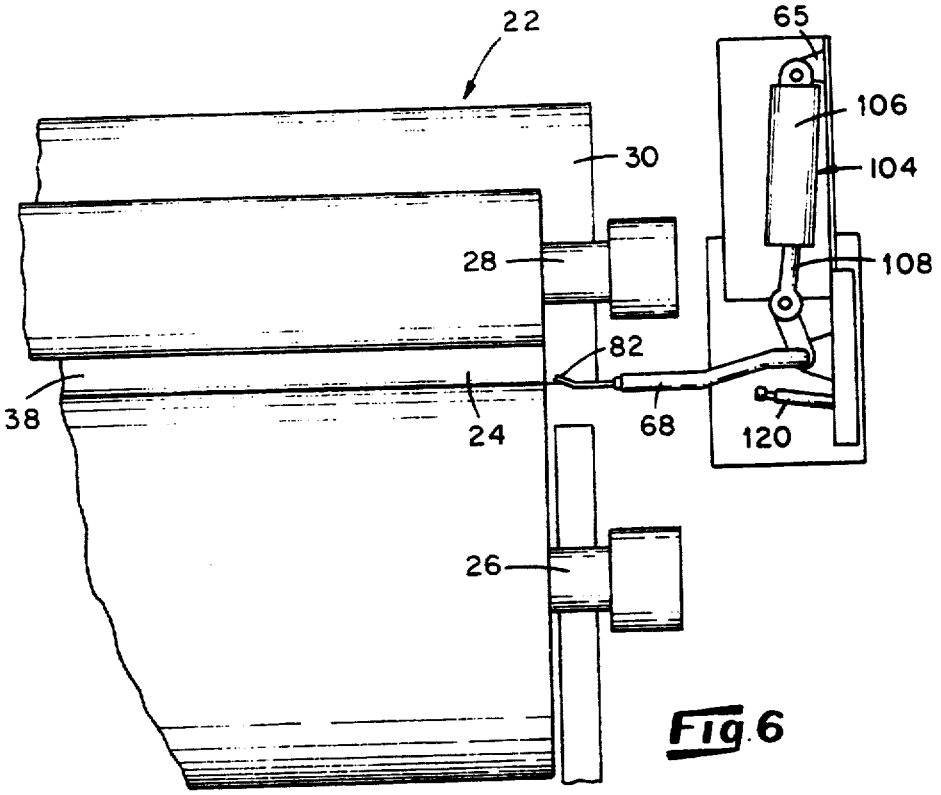
FIGS. 6–9 are fragmentary perspective views illustrating in sequence various stages involved in the use of the FIG. 1 system.

With reference still to FIG. 4, each wand assembly 48 or 49 includes means, generally indicated 84, for mounting the conduit arrangement 68 to the stand 50 in a manner which accommodates movement of the arrangement 68 relative to the stand 50 between an operative condition, as shown in FIG. 6, at which the discharge end 82 of the arrangement 68 is positioned adjacent the section 38 of the paper web 24 moving across the surface of the reel 30 for separating the web section 38 in a manner described herein, and a non-operative, out-of-the way condition, as shown in FIG. 5, at which the discharge end 82 is positioned to one side of the winder 22. The mounting means 84 in the embodiment depicted in FIG. 4 includes a pair of pillow blocks 86 positioned about the vertically-oriented conduit 60 of the arrangement 68 and secured to the side surface 58 of the stand 50. Each pillow block 86 used for securing the conduit arrangement 68 to the support stand 50 includes an internal bearing and collar 88, which is fixedly secured about the surface of the conduit 60 to prevent rotation the collar 88 about the conduit 60 and a mount 90 within which the collar 88 is rotatably positioned. Each mount 90 is, in turn, fixed to the stand side surface 58 so that the blocks 86 accommodate the aforedescribed pivotal movement of the conduit arrangement 68 between the aforementioned operative (FIG. 6) and out-of-the-way (FIG. 5) conditions and supports the weight of the arrangement 68.

At the lower end 70 of the first conduit 60, as shown in FIG. 4, there is provided an entrance within which an adaptor 94 is secured, and an air swivel 96 having an outlet port 98 is threaded accepted by the adaptor 94. The air swivel 96 also has an inlet port 100 to which a hose 102 is attached for receiving air from the pressurized air source 66. During operation of the system 20, the air swivel 96 enables the conduit arrangement 68 to be pivotally moved relative to the support stand 50 without a corresponding movement of the hose 102.

For moving the conduit arrangement 68 of each wand assembly 48 or 49 between its operative and non-operative conditions, the system 20 includes a cylinder assembly 104 for acting between each arrangement 68 and its corresponding stand 50. As best shown in FIG. 4, each cylinder assembly 104 includes an elongated housing 106 and a ram 108 which is positioned within the housing 106 for movement relative thereto between extended and retracted positions. The end of housing 106 opposite the ram 104 includes a clevis 105 is secured to the cylinder mount 65 with a pin 112 so that the housing 106 is thereby pivotally secured to the stand 50. The ram 108 is connected at its end (opposite the housing 106) to the second conduit 62 by way of a clevis arrangement 110 which pivotally joins the ram 108 to the conduit 62. In this connection, the clevis arrangement 110 includes a clevis member 114 attached at the end of the ram 108 and a 116 fixed to one side of the conduit 62. The lug 116 has a through-opening which is aligned with a corresponding opening in the clevis member 114, and a bolt 118 having a shank is directed through and secured within the aligned openings of the lug 116 and clevis member 114.

In the depicted system 20, each cylinder assembly 104 is arranged in such a relationship with the corresponding conduit arrangement 68 so that as the ram 108 is moved between its retracted and extended positions, the discharge end 82 of the conduit arrangement 68 is moved between its operative FIG. 6 position and its non-operative FIG. 5 position. More specifically, as the ram 108 is retracted, the conduit discharge end 82 moves toward in its FIG. 6 operative position, and as the ram 108 is extracted, the conduit discharge end 82 moves toward its non-operative FIG. 5 position. Accordingly, the ram 108 is connected to the conduit 60 through the clevis arrangement 110 so that movement of the ram 108 to its retracted position accurately positions the discharge end 82 in its FIG. 6 operative position adjacent the web 24. As best shown in FIG. 6, an adjustable stop member 120 is fixed upon stand 50 and cooperable with the clevis arrangement 110 to limit the distance that the ram 108 can be extended so that upon movement of the ram 108 to its extended (FIG. 5) limit of travel, the discharge end 82 is positioned in its stored, non-operative FIG. 6 position.

Each cylinder assembly 104 is a double-acting type of cylinder having a pair of internal chambers for urging the ram 108, under the influence of air pressure, toward either of its retracted or extended positions. Air from the pressurized air source 66 is routed to the internal chambers of the cylinder assembly 104 by way of air hoses 122, 124, 126, and an electrically-operated solenoid valve 128 is appropriately connected between the hoses 122, 124, 126 for control of the actuation of the cylinder assembly 104. In the depicted embodiment, the solenoid valve 128 is mounted adjacent the section 56 of the stand 50 and is connected to the hoses 124, 126 so that until the valve 128 is actuated, a first of the internal chambers of the assembly 104 remains pressurized so that the ram 108 is maintained in its extended position and the conduit discharge end 62 is thereby positioned in its non-operative FIG. 5 position. Upon actuation of the valve 128, the air in the first internal chamber of the assembly 104 is vented and the second internal chamber is pressurized so that the ram 108 is moved from its extended position toward its retracted position. As the ram 82 is retracted, the conduit discharge end 82 moves toward its operative FIG. 6 position. Upon de-actuation of the valve 128, the second chamber is vented and the first chamber is re-pressurized to return the ram 108 from its retracted position to its extended position and thus return the conduit discharge end 82 from its operative FIG. 6 position to its non-operative FIG. 5 position. Power for the solenoid valve 128 is supplied from an electric power source (not shown) and actuation of the solenoid valve 128 is controlled by means of an appropriate, e.g., two-position, switch 132 mounted at the central command station 130 where it is accessible to an operator.

As mentioned earlier, each of the conduit arrangement 68 and the cylinder assembly 104 receives air for operation from a pressurized air source 66, depicted in FIG. 4. Although the source 66 may be provided by any of a number of pressurized air sources, such as a canister of compressed air, the depicted source 66 is provided by a source of compressed air which is commonly available through appropriate piping routed through the paper mill in which the winder 22 is located. Typically, the air pressure available at such a source 66 is maintained between about 80 and 85 psig. Moreover, the air source 66 is provided with suitable fitting to which the hose 102, introduced earlier, is connected for routing compressed air to the inlet port 100 of the air swivel 96.

With reference still to FIG. 4, the control of air conducted to the conduit arrangement 68 can be had with an electrically-operated solenoid valve 136 mounted in the hose 102. The solenoid valve 136 is normally-closed so that until the valve 136 is actuated, air is prevented from flowing through the hose 102 from the source 66. When the solenoid valve 136 is actuated, air is permitted to flow through the conduit arrangement 68 and out of the discharge end 82. There is associated with the command station 130 a time delay 138 appropriately wired to the solenoid valve 136 to prevent the de-actuation of the valve 136 until a preselected period of time, e.g., 10–15 seconds following initial actuation of the valve 136. The time delay provided by the relay 138 is advantageous in that it ensures that the period of time during which air is conducted through the discharge end 82 toward the web 24 is sufficient to effect separation of the web 24 in the manner described herein. The solenoid valve 136 is suitably wired to an electrical power source 132 for receiving power therefrom, and actuation of the valve 136 is controlled by means of a two-position switch 140 mounted at the command station 130.

Figure 7:
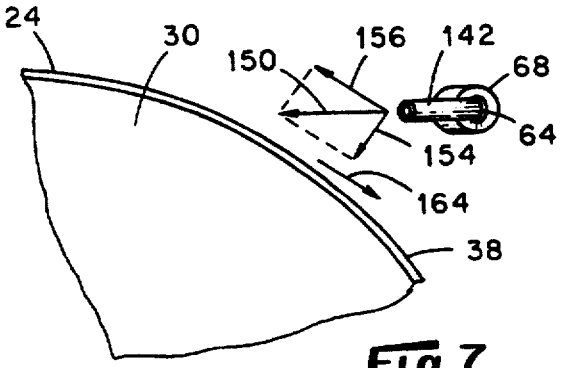
Figure 8:
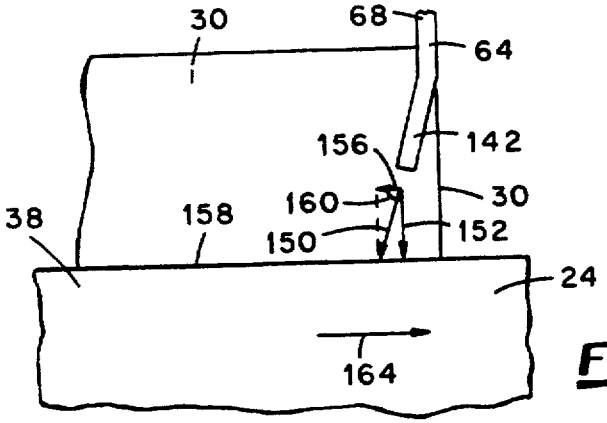

When the conduit discharge end 82 is positioned in its operative position, and as mentioned earlier, the discharge end 82 of each conduit arrangement 68 is directed generally toward the section 38 of the paper web 24 moving across the reel 30 in a manner which effects a separation of the web 24 along one edge thereof. To this end and with reference to FIGS. 7 and 8, the conduit 64 of each arrangement 68 has a portion 142 adjacent the discharge end 82 which is shaped so that when the discharge end 82 is positioned in its operative position, the discharge end 82 is situated to one side of the corresponding edge, such as edge 158 in FIG. 8, of the web 24 and spaced a short distance from the surface of the reel 30 so that the air which exits the discharge end 82 is directed along a path, indicated 150 in FIGS. 7 and 8, having one directional component 152 (FIG. 8) which is directed generally across the surface of the reel 30, a second directional component 154 directed generally toward, i.e., normal to, the surface of the reel 30 and a third directional component 156 directed generally upstream of the web 24. The direction of movement of the web 24 past the discharge end 82 is indicated in FIGS. 7 and 8 by the arrow 164. In the depicted embodiment, and with reference to FIG. 8, the path 150 of movement of the air exiting the discharge end 82 forms an angle of about 75 degrees with the third (upstream) directional component 156 corresponding with the direction opposite the direction of web movement.

At the outset of an operation cycle of the system 20, the conduit arrangement 68 is positioned in its non-operative FIG. 5 position to accommodate passage of the primary arms 46 of the transfer system 44 along the sides of the winder 22, and each solenoid valve 128 and 136 remains unactuated. When the operator visually detects that the drum 26 is fully wound with the web 24, the operator initiates the operation of the transfer system 44 so that the second drum 26 is moved into its superposed (FIG. 2 solid-line) position upon the reel 30. The cylinder solenoid valve 128 is then actuated so that the conduit arrangement 68 is moved into its operative FIG. 6 position. The conduit solenoid valve 136 is then actuated so that a sudden blast of air exits the discharge end 82.

Figure 9:
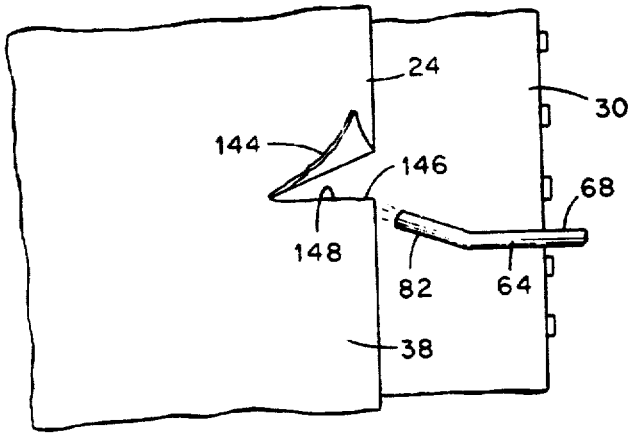
Figure 10:
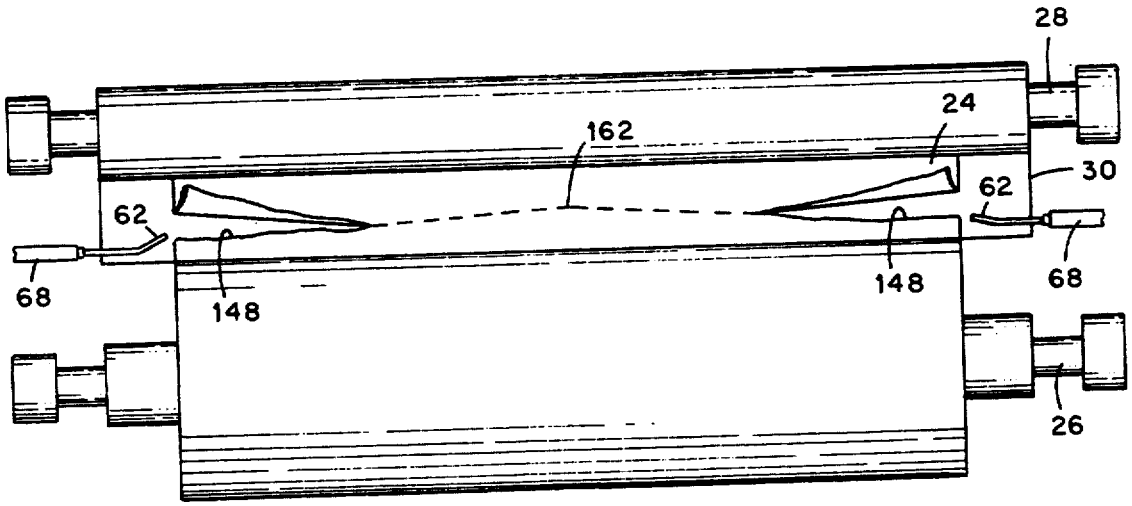
FIG. 10 is a perspective view of the severance path of the web as a consequence of the impact of the air blast against the web.

As best shown in FIG. 9, the sudden blast of air from the conduit discharge end 82 strikes the portion 38 of the web 24 adjacent the corresponding web edge with sufficient strength to separate the web portion 38 struck by the blast into upstream and downstream sections 144 and 146, respectively, disposed on opposite sides of a formed path, indicated 148, of separation. Although the path 148 formed as a consequence of the impact of the air blast against the web 24 is relatively short, this formed path 148 weakens the tension-resisting strength of the web 24 to such an extent that the web 24 can no longer withstand the tension forces to which the web 24 is exposed. Consequently, the web 24 is severed along a path of severance extending generally traversely across the web 24 from the formed path 148 of separation. In practice and with reference to FIG. 10, since the turn up system 20 includes conduit arrangements 68 positioned along each side edge of the web 24 for simultaneously forming a path of separation 148 thereat, the complete severance of the web 24 is initiated along each side thereof so the path of severance, indicated 162 in FIG. 10, converges from each web side toward the center of the web. As shown in FIG. 10, the severance path 162 resembles a chevron in shape. The speed which with the web 24 is completely severed from side-to-side is relatively fast, and normally less than 1.0 seconds from the instant that a blast of air is emitted from each conduit discharge end 82.

In addition to the separation of the web 24 adjacent each of its side edges, the air blast emitted from each conduit discharge end 82 also effects the movement of the severed, i.e., upstream, section of the web 24 away from the surface of the reel 30 and generally toward the second drum 28. As an aid in this regard, the web 24, when severed, possesses a tendency to curl back upon itself. However, in order for the severed, upstream web section to curl toward the second drum 28, the severed web section has to be biased toward the direction of the desired curl in order for the severed web section to curl in the desired direction. In the depicted system 20 and with reference again to FIG. 9, air blast which exits the discharge end 82 turns the severed upstream web section 144 upwardly toward the second drum 28 in an action due, at least in part, to the air drag created across the upper surface of the web 24 as air from the blast moves across the upper surface of the web 24. With the curl of the upstream web section 144 directed upwardly in this manner, the remainder of the web 24, when completely severed, curls upwardly as well. Thereafter, with the severed web 24 curled upwardly and about the second drum 28, the continuing rotation of the drum 28 wraps the web 24 thereabout.

To summarize the operation of the system 20, the conduit arrangements 68 of the wand assemblies 48 and 49 are initially positioned in the non-operative (FIG. 5) positions while the first drum 26 is being wound, and the solenoid valves 128 associated with each wand assembly 48 or 49 is closed so as to prevent air from the source 66 from exiting the discharge end 82 of each corresponding conduit arrangement 68. An operator situated at the central command station 130 visually monitors the winding operation, and when he sees that the first drum 26 is about to be fully wound, he initiates the operation of the transfer system 44 so that the second, i.e., empty, drum 28 is moved into the superposed position upon the reel 30. The conduit arrangements 68 of the turn up system 20 are then moved into the operative (FIG. 6) positions so that the discharge end 82 of each conduit is directed generally toward the portion of the web 24 adjacent the corresponding web side edge. When the operator determines that the first drum 28 is full, he then actuates the solenoid valves 128 so that an air blast suddenly exits the discharge end 82 of each conduit arrangement 68. This sudden air blast initiates the separation of the web 24 adjacent each of its side edges so that the tension to which the web 24 is exposed completes the severance of the web 24 along a path extending traversely across the web 24 and directs the severed, i.e., upstream, edge of the web 24 upwardly toward the second drum 28. The tendency of the severed (upstream) web edge to curl thereafter moves the web 24 over the second drum 28 so that the rotation of the drum 28 wraps the web 24 thereabout.

Upon maneuverance of the severed web end upon the second drum 28, the solenoid valve 128 is de-actuated so that the air flow through each conduit arrangement 68 is shut off (following a period of 10 to 15 seconds from the opening of the valve 128) and the positions. The full drum 26 is subsequently removed from its position adjacent the reel 30 and the transfer system 44 is appropriately operated to move the second drum 28, while the web 24 is being wound thereabout, into the position adjacent the reel 30 formerly assumed by the first drum 26.

It will be understood that numerous modifications and substitutions can be had to the aforedescribed embodiment without departing from the spirit of the invention. For example, although the aforedescribed system 20 has been shown and described as including two conduit arrangements 68 disposed on opposite sides of the web 24, a system in accordance with the broader aspects of this invention may possess only a single wand assembly. Accordingly, the aforedescribed embodiment 20 is intended for the purpose of illustration and not as limitation.

What is claimed is:

1. A method for severing and turning up a web of paper in the absence of a knife-like tool for severing the web, the web moving in a tensioned condition across the surface of a rotating reel at a winder of a paper making machine from a first drum about which the paper web is being wound to a second drum wherein the first drum is disposed adjacent the reel and the second drum is superposed upon the reel so as to overlie the paper web moving thereacross toward the first drum, the method comprising the steps of:

providing a conduit for receiving air from a pressurized air source and having a discharge end through which pressurized air from the source exits the conduit in an air stream;

moving the conduit from a non-operative, out-of-the-way position disposed to one side of the reel and an operative position at which the discharge end of the conduit is disposed adjacent and is directed toward an edge portion of the web which overlies the surface of the reel at a location generally between the first and second drums and wherein the air stream which exits the discharge end moves toward the web edge portion along a path having one directional component which is directed generally upstream of the web; and initiating a sudden stream of air through the conduit so that the stream of air which exits the conduit severs the web into upstream and downstream sections of web and urges the upstream section of web away from the surface of the reel and toward the second drum for winding thereabout, the upstream and downstream sections of web being disposed on opposite sides along a path of separation extending from the corresponding portion adjacent the edge of the web, whereby the tension to which the web is exposed completes severance of the web along the formed path of separation to provide the web with a severed edge extending between the opposite side edges of the web.

2. The method of claim 1 further comprising spacing the conduit so that when the conduit is in the operative position the discharge end of the conduit is spaced a relatively short distance from the surface of the reel and slightly to one side of the edge portion of the web whereby the path along which the air stream is directed as the air stream exits the discharge end has a second directional component which is directed generally toward the reel surface and has a third directional component which is directed generally across the web.

3. The method of claim 1 wherein the conduit comprises a first conduit having an entrance end opposite the discharge end and a second conduit having an exit end through which air from the pressurized source is conducted to the entrance end of the first conduit, whereby the entrance end of the first conduit is releasably joined to the exit end of the second conduit to accommodate the ease of attachment of the first conduit to and detachment of the first conduit from the second conduit.

4. The method of claim 1 wherein the conduit has an L-shaped arrangement through which air is conducted to the conduit for discharge through the discharge end whereby one leg of the L-shaped arrangement is supported by a supporting means for rotating the conduit about a longitudinal axis of the one leg between a first angular position at which the conduit is positioned in its operative position and a second angular position at which the conduit is positioned in its non-operative position.

5. The method of claim 4 wherein another leg of the L-shaped conduit is oriented at substantially a right angle with respect to the one leg, and the one leg is supported for rotation about a generally vertical axis so that movement of the conduit between the operative and non-operative positions moves the other leg along a substantially horizontal path.

6. The method of claim 1 wherein the conduit is supported by a supporting means and the supporting means includes a brand positionable in a stationary condition adjacent the winder whereby the conduit is pivotally attached to the stand for movement between the operative and non-operative positions.

7. The method of claim 6 further comprising a cylinder assembly having a cylinder and a ram slidably positioned within the cylinder for longitudinal movement relative thereto between a retracted position and an extended position for moving the conduit between its operative and non-operative positions as the ram is moved between its retracted and extended positions, said cylinder assembly being connected to the stand and said ram being connected to the conduit.

8. The method of claim 1 further comprising a solenoid valve connected in-line with the conduit whereby actuation and de-actuation of the valve alternately permits and shuts off the sudden stream of air flowing through and exiting the conduit.

9. The method of claim 26 further comprising a time delay device associated with the solenoid valve for preventing the flow of air exiting the conduit from being shut off for a predetermined period of time following the moment at which the sudden stream of air is permitted to flow through and exit the conduit.

10. A method for severing and turning up a web of paper in the absence of a knife-like tool for severing the web, the web moving in a tensioned condition across the surface of a rotating reel at a winder of a paper making machine from a first drum about which the paper web is being wound to a second drum wherein the first drum is disposed adjacent the reel and the second drum is superposed upon the reel so as to overlie the paper web moving thereacross toward the first drum, the method comprising the steps of:

providing a conduit disposed to one side of the reel for initiating a separation of one edge portion of the web and another air conduit disposed to an opposite side of the reel for initiating a separation of an edge portion of the web opposite the one edge portion, each of said conduit for receiving air from a pressurized air source and having a discharge end through which pressurized air from the source exits the conduit in an air stream, each of said conduit being supported by a support means disposed to the one side and the opposite side of the reel for supporting said conduit for movement of the conduit between a non-operative, out-of-the-way position to an operative position;

moving each of said conduit from the non-operative, out-of-the-way position to the operative position so that the discharge end of each conduit is disposed adjacent and is directed toward an edge portion of the web which overlies the surface of the reel at a location generally between the first and second drums and wherein the air stream which exit the discharge end of each conduit moves toward a portion of the web adjacent each edge along a path having one directional component which is directed generally upstream of the web, having a second directional component which is directed generally toward the reel surface and having a third directional component which is directed generally across the web; and initiating a sudden stream of air through each of said conduits so that the stream of air which exits the conduits severs the web into upstream and downstream sections of web and urge the upstream section of web away from the surface of the reel and toward the second drum for winding thereabout, the upstream and downstream sections of web being disposed on opposite sides along a path of separation extending from the corresponding portion adjacent the edges of the web, whereby the tension to which the web is exposed completes severance of the web along the formed path of separation to provide the web with a severed edge extending between the opposite side edges of the web.

11. The method of claim 10 wherein each conduit comprises a first conduit having an entrance end opposite the discharge end and a second conduit having an exit end through which air from the pressurized source is conducted to the entrance end of the first conduit, whereby the entrance end of the first conduit is releasably joined to the exit end of the second conduit to accommodate the ease of attachment of the first conduit to and detachment of the first conduit from the second conduit.

12. The method of claim 10 wherein each conduit has an L-shaped arrangement through which air is conducted to the conduit for discharge through the discharge end whereby one leg of the L-shaped arrangement is supported by a supporting means for rotating the conduit about a longitudinal axis of the one leg between a first angular position at which the conduit is positioned in its operative position and a second angular position at which the conduit is positioned in its non-operative position.

13. The method of claim 12 wherein another leg of each L-shaped conduit is oriented at substantially a right angle with respect to the one leg, and the one leg is supported for rotation about a generally vertical axis so that movement of each conduit between the operative and non-operative positions moves the other leg along a substantially horizontal path.

14. The method of claim 10 wherein each conduit is supported by a supporting means and the supporting means includes a stand positionable in a stationary condition adjacent the winder whereby the conduit is pivotally attached to the stand for movement between the operative and non-operative positions.

15. The method of claim 14 further comprising a cylinder assembly having a cylinder and a ram slidably positioned within the cylinder for longitudinal movement relative thereto between a retracted position and an extended position for moving each conduit between its operative and non-operative positions as the ram is moved between its retracted and extended positions, said cylinder assembly being connected to each stand and said ram being connected to each conduit.

16. The method of claim 10 further comprising solenoid valves connected in-line with the conduits whereby actuation and deactuation of the valves alternately permits and shuts off the sudden stream of air flowing through and exiting each conduit.

17. The method of claim 16 further comprising a time delay devices associated with each solenoid valve for preventing the flow of air exiting the conduit from being shut off for a predetermined period of time following the moment at which the sudden stream of air is permitted to flow through and exit each conduit.

* * * * *

UNITED STATES PATENT AND TRADEMARK OFFICE

CERTIFICATE OF CORRECTION

PATENT NO. : 5,377,930

DATED : January 3, 1995

INVENTOR(S) : Steven Noyes

It is certified that error appears in the above-indentified patent and that said Letters Patent is hereby corrected as shown below:

Column 5, line 53, after "rotation" insert --of--.

Column 6, line 20, after "a" insert --lug--.

Column 11, Claim 6, line 6, delete "brand" and insert --stand--.

Column 11, Claim 9, line 24, change "26" to --8--.

Signed and Sealed this

Fourteenth Day of March, 1995

Bruce Lehman

*Attest:*

BRUCE LEHMAN

*Attesting Officer*

*Commissioner of Patents and Trademarks*